US007263916B1

(12) United States Patent
Wu

(10) Patent No.: US 7,263,916 B1
(45) Date of Patent: Sep. 4, 2007

(54) ELECTRIC WRENCH

(75) Inventor: Arthur Wu, Taichung Hsien (TW)

(73) Assignee: Proxene Tools Co., Ltd, Taichong (TW)

( * ) Notice: Subject to any disclaimer, the term of this patent is extended or adjusted under 35 U.S.C. 154(b) by 0 days.

(21) Appl. No.: 11/480,624

(22) Filed: Jul. 5, 2006

(51) Int. Cl.
*B25B 21/00* (2006.01)
*B25B 13/16* (2006.01)
*B25B 9/00* (2006.01)

(52) U.S. Cl. ..... 81/57.14; 81/165; 81/170

(58) Field of Classification Search ..... 81/57.14, 81/165, 170
See application file for complete search history.

(56) References Cited

U.S. PATENT DOCUMENTS 4,512,221 A * 4/1985 Picone ..... 81/170
6,477,921 B1 * 11/2002 Picone ..... 81/170
6,739,221 B2 * 5/2004 Cha ..... 81/57.13
6,966,242 B2 * 11/2005 Picone ..... 81/165
7,114,824 B2 * 10/2006 Picone ..... 362/119

* cited by examiner

*Primary Examiner*—David B Thomas
(74) *Attorney, Agent, or Firm*—Alan Kamrath; Kamrath & Associates PA

(57) ABSTRACT

An electric wrench comprises a main body with a head portion, a handle and a neck portion, a worm gear disposed in a receptacle in the head portion and engaged with a movable jaw on top of the head portion, a flexible member disposed between the worm gear and a major gear wheel, a motor housed in a first open space in the main body and connected to a minor gear wheel below the major gear wheel through a second transmission member electrically connected to a battery in a second open space in the main body, a switch unit electrically connected the motor for controlling the activation of the motor and a side cover detachable for covering the first and the second open spaces. Thereby, the motor can drive a slide motion of the movable jaw through the various transmission parts so as to change the clip size of the electric wrench.

8 Claims, 7 Drawing Sheets

ELECTRIC WRENCH

FIELD OF THE INVENTION

The present invention relates to electric wrenches, more particularly to an electric wrench wherein the slide motion of the movable jaw is powered by a low electric current.

BACKGROUND OF THE INVENTION

An electric wrench of the prior art as disclosed by U.S. Pat. No. 6,477,921 uses a low electric current to drive a driving piece with a side projection to collide with a worm gear so as to activate a sudden movement of the worm gear, whereby a movable jaw will shift on top of a wrench so as to change the clip size of the wrench. It is advantageous to use a lower driving current since the lifespan of the battery can be significantly prolonged. However, there still exist disadvantages of the housing of the motor and the destructive collusion between the worm gear and the driving piece.

The various objects and advantages of the present invention will be more readily understood from the following detailed description when read in conjunction with the appended drawings.

SUMMARY OF THE INVENTION

Accordingly, the primary objective of the present invention is to provide an electric wrench driven by a low electric current, whereby its lifespan will be significantly extended.

To achieve above object, the present invention provides an electric wrench which comprises a main body further including an enlarged head portion, a handle and a neck portion connecting said head portion and said handle, a first side of said head portion being provided with a fixed jaw and a second side a movable jaw with a gear-teethed inner bottom thereof, a slot formed aside said fixed jaw toward said movable jaw, whereby said movable jaw can slide along said slot, said head portion being further provided with an inner receptacle connected to said slot, said handle and said neck portion being respectively provided with a first open inner space and a second open inner space; a worm gear disposed in said receptacle and engaged with said movable jaw, whereby said movable jaw can slide toward or away from said fixed jaw; a flexible member disposed between said worm gear and said major gear wheel, whereby said flexible member will be twisted, said major gear wheel and a minor gear being connected through a first transmission member; a motor housed in said first open space and connected to said minor gear wheel through a second transmission member, said motor being electrically connected to a battery in said second open space; a switch unit electrically connected said motor for controlling the activation of said motor; and a side cover detachable from said main body for covering said first and said second open spaces.

The secondary objective of the present invention is to provide an electric wrench that will not modify the outlook from a conventional wrench appreciably.

DETAILED DESCRIPTION OF THE PREFERRED EMBODIMENTS

Figure 1:
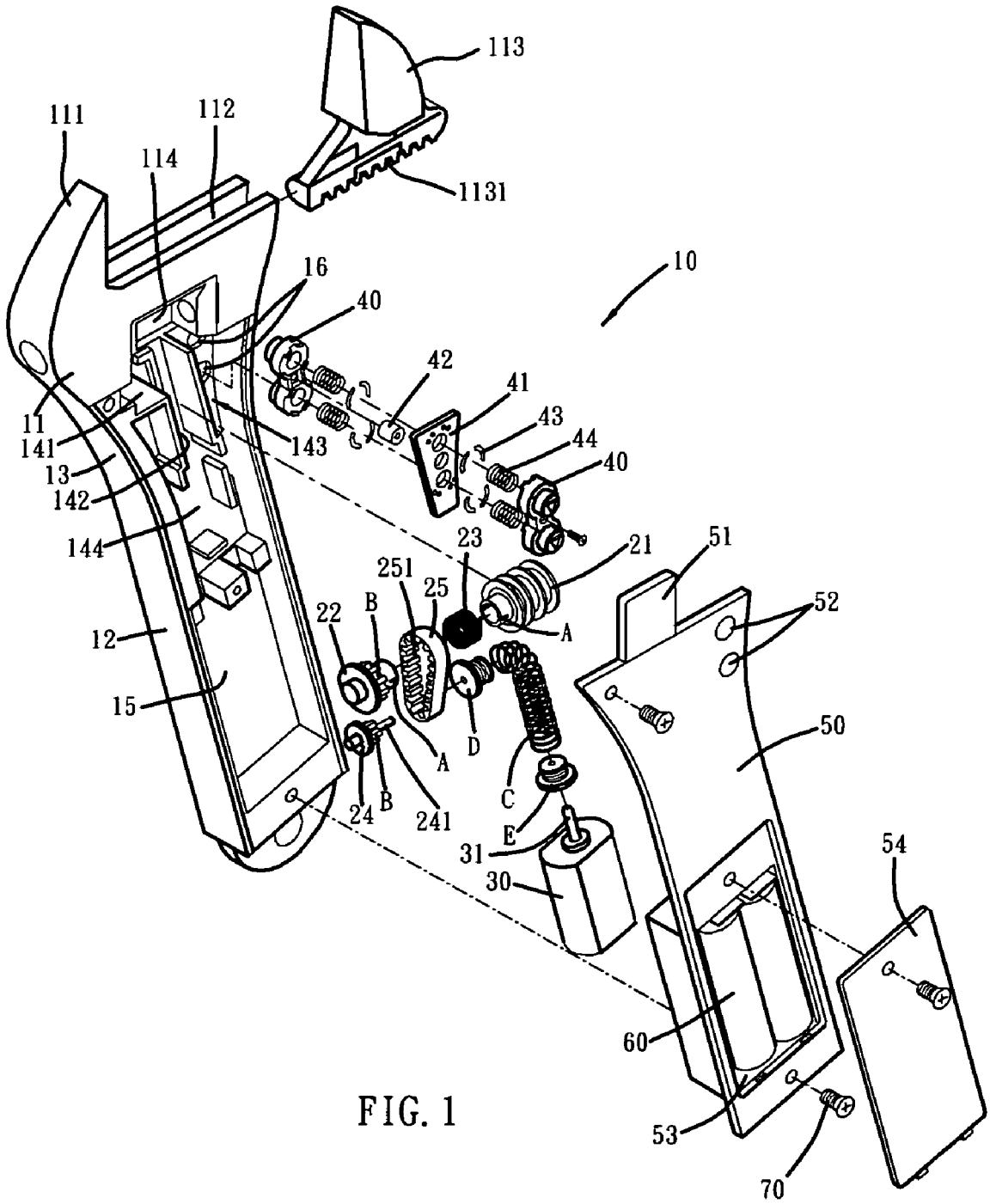
FIG. 1 is an exploded perspective view of an electric wrench of the present invention.
Figure 2:
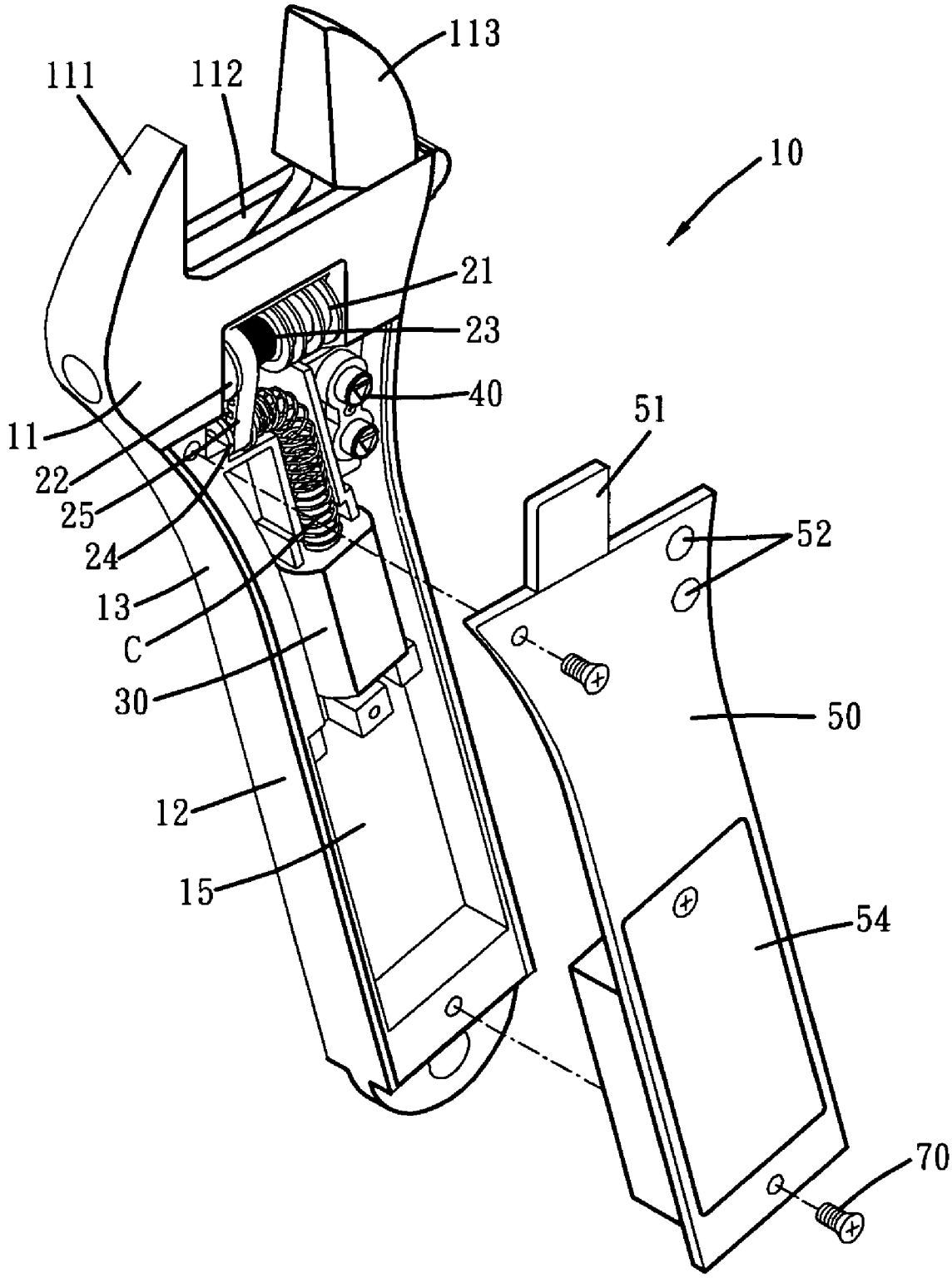
FIG. 2 is a perspective view of the electric wrench in FIG. 1 with the side cover thereof separated aside.
Figure 3:
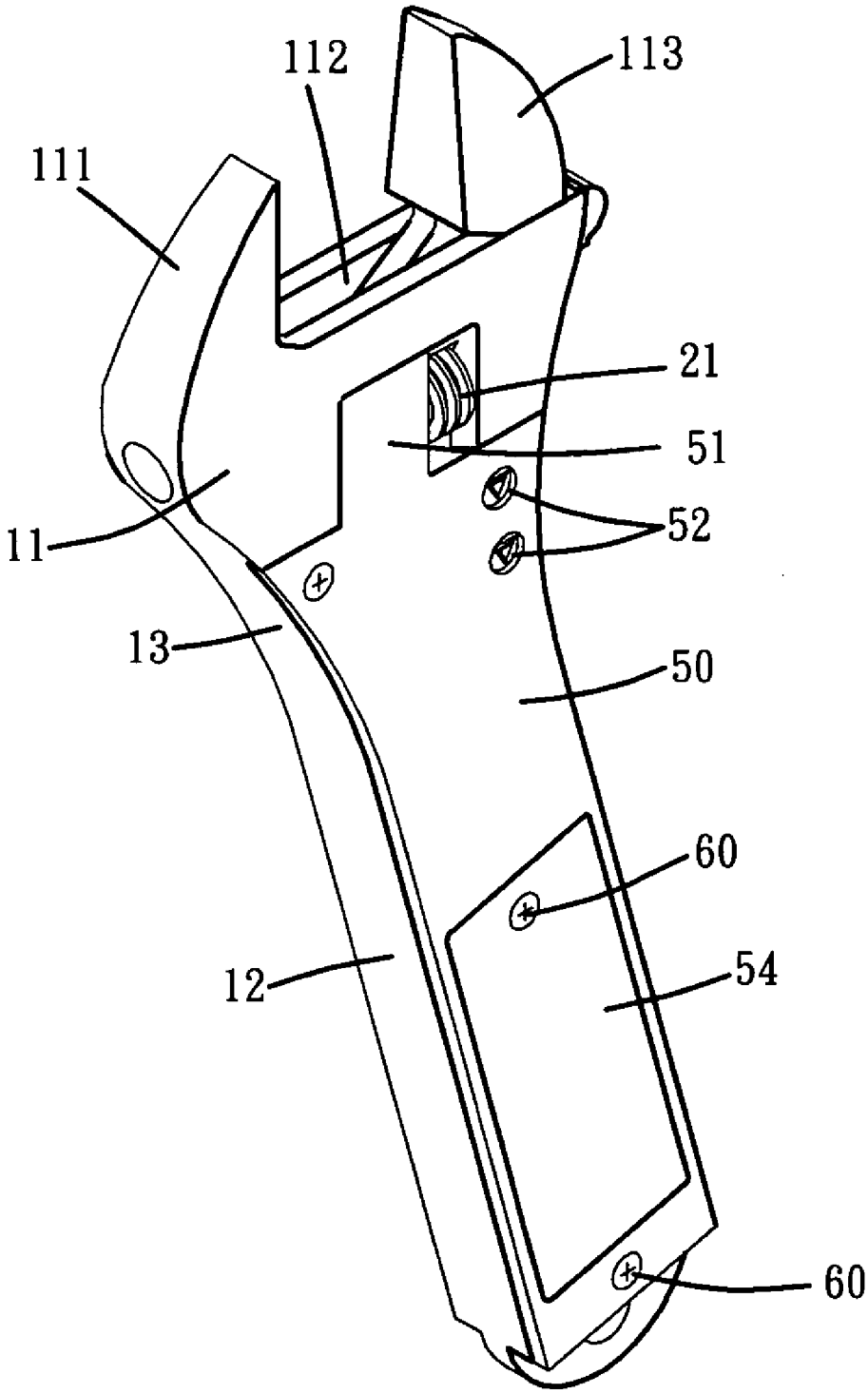
FIG. 3 is a perspective view of the electric wrench in FIG. 1.

Referring to FIGS. 1 to 3, an electric wrench driven by a low electric current comprises a main body 10, a motor 30, a transmission unit C, a button switch unit 40, a side cover 50 and a battery 60. The main body 10 further includes an enlarged head portion 11, a handle 12 and a neck portion 13 connecting the head portion 11 and the handle 12. One side of the head portion 11 is provided with a fixed jaw 111 and the other side a movable jaw 113 having a gear-teethed inner bottom 1131; there is a slot 112 formed aside the fixed jaw 111 toward the movable jaw 113, whereby the movable jaw 113 can slide along the slot 112. The head portion 11 is further provided with an inner receptacle 114 connected to the slot 112, and the handle 12 and the neck portion 13 are respectively provided with a first open inner space and a second open inner space 15. The first open inner space provided with dividers that divide it into a first region 141 and a second region 142 connected with the first region 141, a third region 143 adjacent to the movable jaw 113 and a fourth region 144 next to the second open space 15. (However, the number regions can be adjusted according to necessities.)

The worn gear 21 is disposed in the receptacle 114 and engaged with the gear-teethed inner bottom 1131 of the movable jaw 113, whereby the movable jaw 113 will slide toward or away from the fixed jaw 111 along the slot 112. The worn gear 21 and the major gear wheel 22 are coaxially aligned, respectively having slots A on rod sections extended toward each other for retaining a torsion spring therebetween. Further, the major gear wheel 22 is connected with a minor gear wheel 24 having an outer gear wall B and situating in the first region 141 through a transmission member 25 with an inner gear surface 251, whereby the major gear wheel 22 and the minor gear wheel 24 are moved synchronically.

The motor 30 is disposed in the fourth region 144, with a shaft 31 extended from one end thereof.

The transmission unit C is a flexible part housed in the second region 142 and two T-shaped first and second connectors D, E, being respectively coupled with the shaft 241 of the minor gear wheel 24 and the shaft 31 of the motor 30. Equivalently, the transmission unit C can be replaced by a bevel wheel whose gear wheel is engaged with the minor gear wheel 24 and shaft is connected with the motor shaft.

The button switch unit 40 may have one set or two sets of switch buttons, which is housed in the third region 143. One side of the button switch unit 40 is mounted on a retaining plate 41, and the opposite side thereof is supported against a hole 16 in the main body 10 and the through hole 52 of the side cover 50. Further, the two buttons of the either set of the button switch unit 40 move oppositely by pivoting about a fixed column 42 going through a middle hole on the retaining plate 41. There are electrodes 43 and springs 44 between the button switch unit 40 and the retaining plate 41.

A side cover 50 for covering the first and second open spaces by the screw units 70 is detachable from the main body 10. The major gear wheel 22 is partially covered by an extended portion 51 from the upper end of the side cover 50, whereby the major gear wheel 22 will be stably housed in the receptacle 114. Further, the side cover is provided with a through hole 52 for retaining the switch unit, whereby a finger of the user can touch the buttons thereon. The buttons are preferably designed to be lower than the surrounding surface of the side cover, so that a holding hand will not accidentally activate the switch unit.

The battery 60 housed in the second open space is connected electrically to the motor 30. As shown in the figure, the second open space is a long cavity 53 with in the main body 10, which can be covered by the side cover 50. It is sealed by a cover plate 54 to form an electric wrench ready for use, as shown in FIG. 3.

Figure 4:
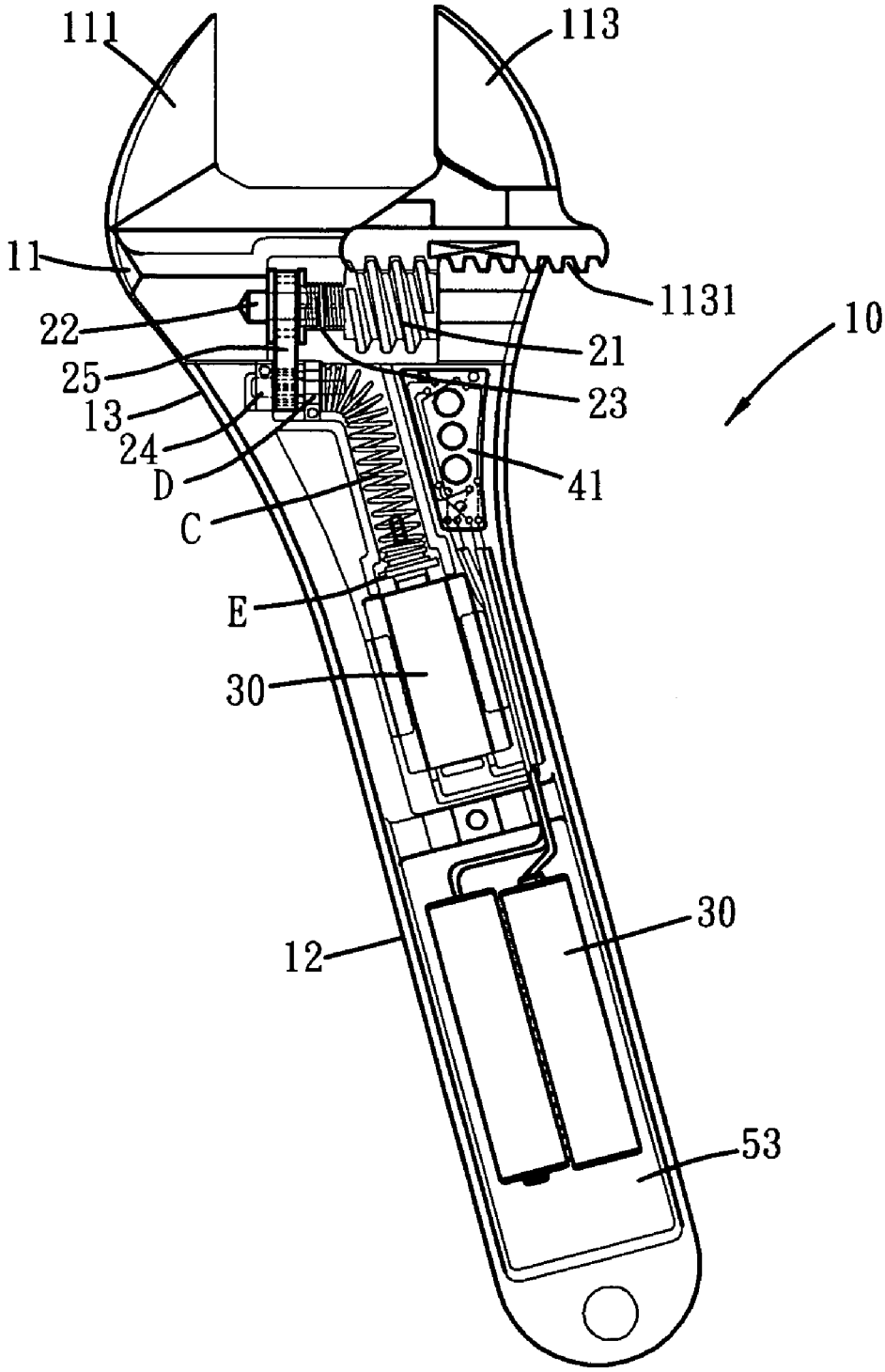
FIG. 4 a side view of the electric wrench in FIG. 1 with the side cover thereof removed.
Figure 5:
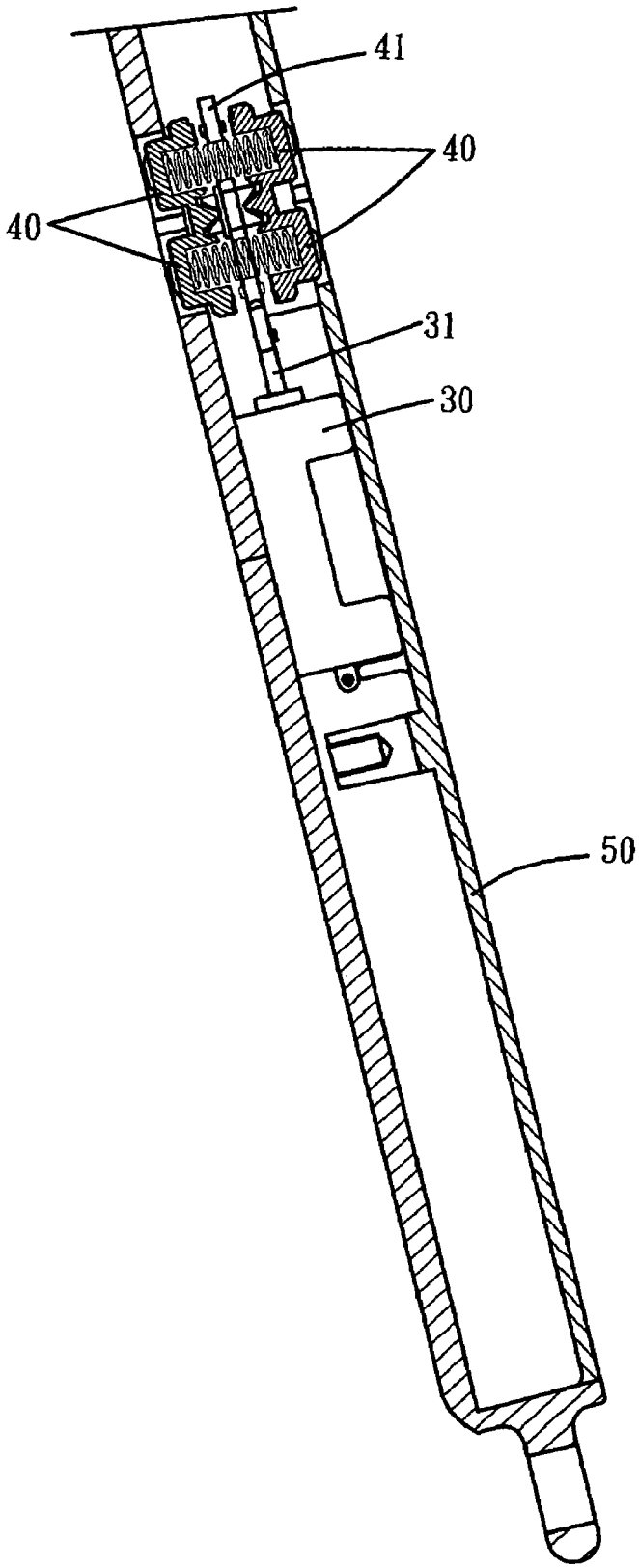
FIG. 5 is a lateral cross-sectional view of the electric wrench in FIG. 1.

Referring to FIGS. 4, 5, the operation is elaborated as follows.

The present invention utilizes a lower electric current to drive the movable jaw 113, thereby changing the clip size between the fixed jaw 111 and the movable jaw 113. A user touches the buttons respectively marked right and left of the switch unit 40 to start the motor 30. Consequently, the first and the second end connectors D, E are driven to twist the transmission unit C, and then the minor gear wheel 24 starts to rotate. The major gear wheel 22 connected to the minor gear wheel 24 through the transmission member 25 will therefore rotate accordingly. Eventually, the worm gear 21 connected to the major gear wheel 22 through the flexible member 23 will rotate to drive the slide motion of the movable jaw 113 along the slot 112.

An electric wrench of the present invention uses a low electric current to drive a slide motion of the movable jaw 113, however a large enough instantaneous voltage cannot be provided by a low electric current. To tackle this problem, the flexible member 23 between the worn gear 21 and the major gear wheel 22 is used to acclimate a significant amount of energy for releasing a large torsion in a sudden that needed to start the motion of the movable jaw 113. Thereby, a low electric current can be used to adjust the clip size of the wrench.

The present invention uses a low electric current to drive a motor, and then the motor is coupled with a flexible unit 23, taking the form of a torsion spring, so as to drive the movable jaw 113 of a wrench. Thereby, the lifespan of the battery 60 is increases. The flexible unit 23 is a buffer of energy so that the movable jaw 113 can be started by a larger sudden power. Therefore, the worm gear 21 and the major gear wheel 22 will not collide and wear out each other, lasting the lifespan of the electric wrench. Since the driving current is low, the hazard to a misplaced finger by the jaws can be avoided. Further, the main body 10 of the wrench is provided with first and second open spaces, whereby the driving parts for the movable jaw can be hidden. Therefore, the present invention is easier to hold. The switch unit 40 of the motor is located at the neck portion 13 of the wrench, and the buttons thereon is lower than the surrounding surface of the side cover. Therefore, accidental activation when the wrench is placed flatly is not possible. Further, the accidental touch by a holding hand in operation is also not likely.

Figure 6:
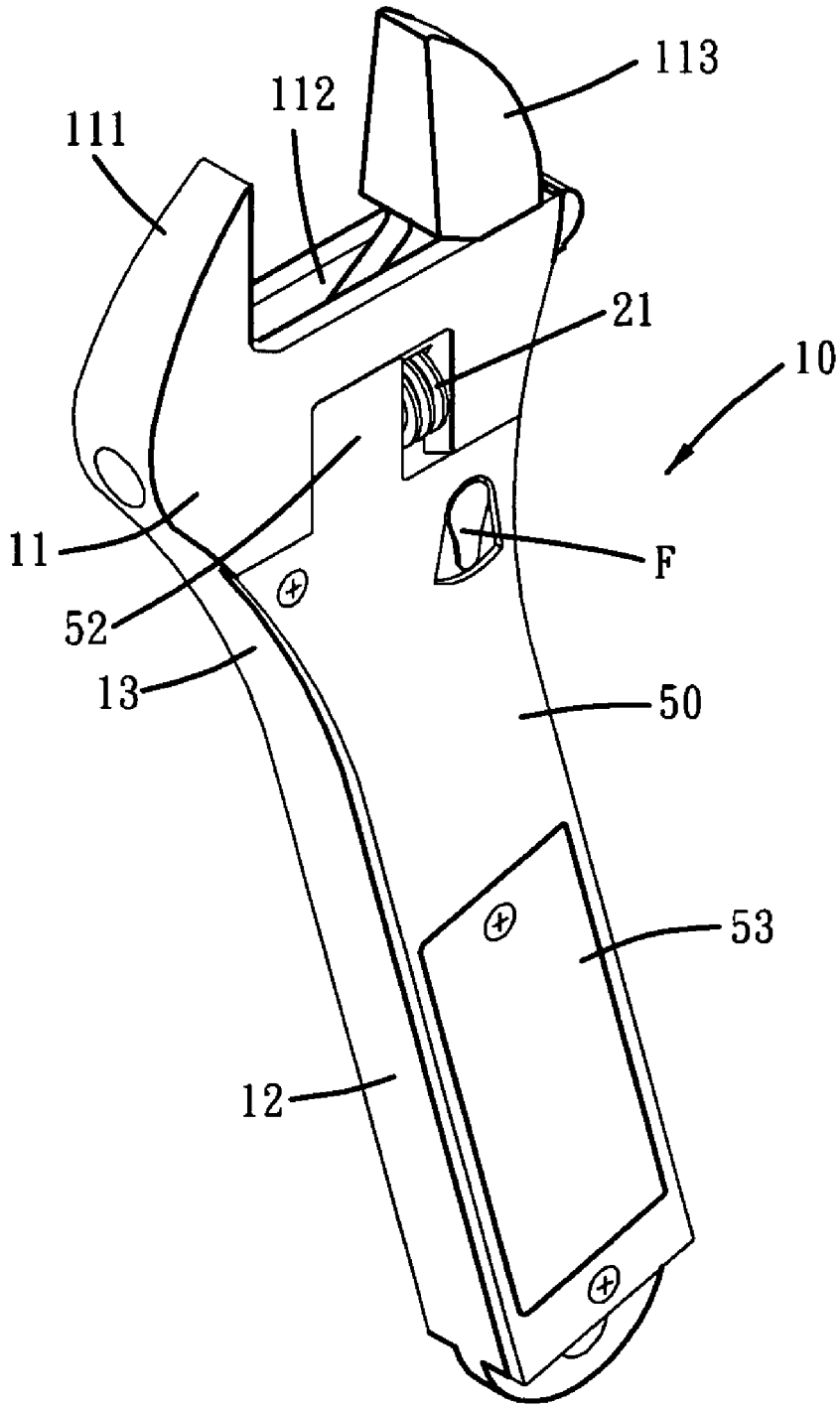
FIG. 6 is a perspective view of the second preferred embodiment of the electric wrench of the present invention.
Figure 7:
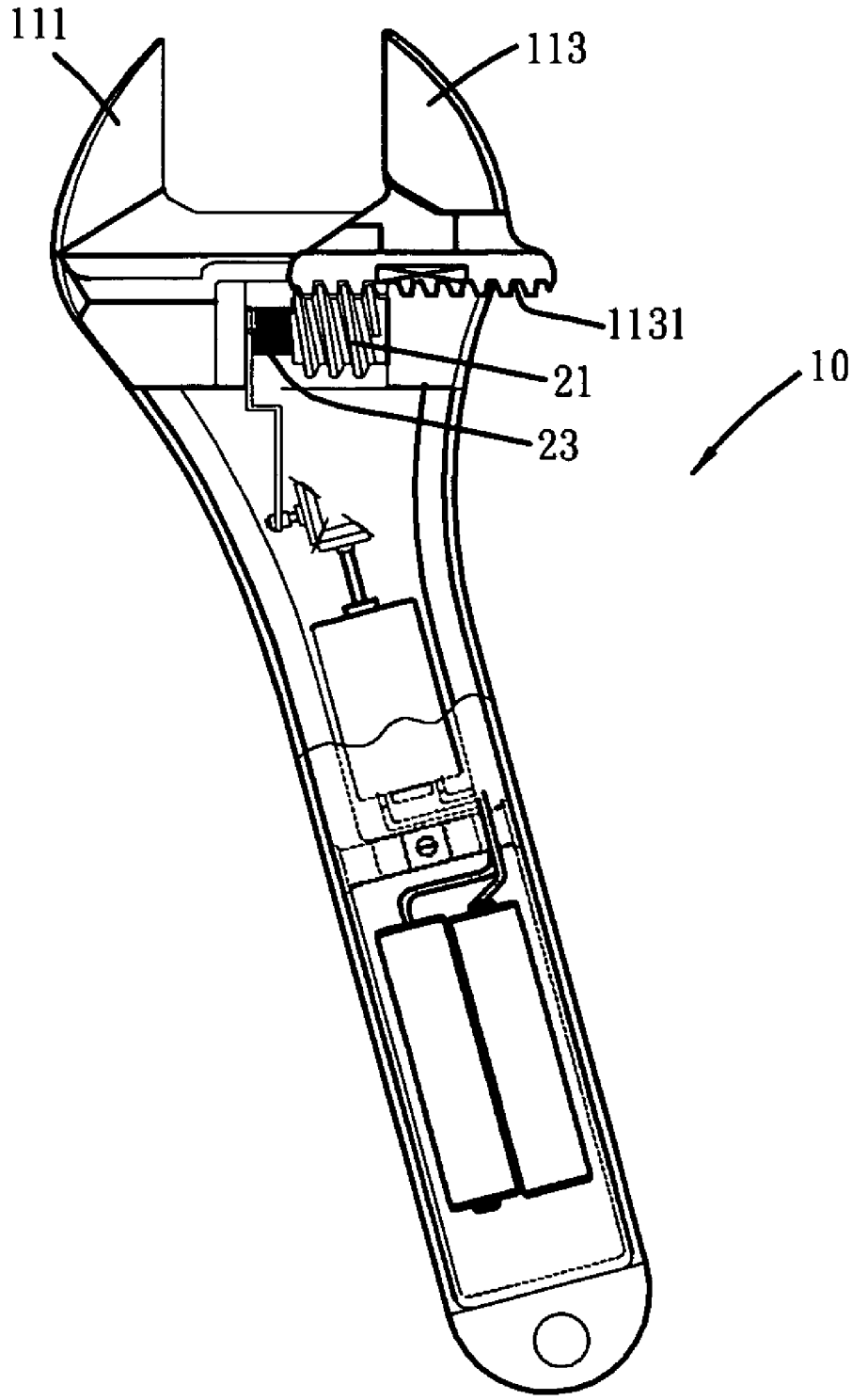
FIG. 7 is a side cross-sectional view of another preferred embodiment of the present invention.

Referring to FIG. 6, the second preferred embodiment of the present invention up/down type of button switch unit 40 is replaced by left/right dial type switch unit F. The dial switch unit is preferably lower than the surrounding surface of the side cover so that a holding hand will not accidentally activate the switch unit. The left/right dial will be activated to change the clip size between the fixed and movable jaws.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electric wrench, comprising:

a main body further including an enlarged head portion, a handle and a neck portion connecting said head portion and said handle, a first side of said head portion being provided with a fixed jaw and a second side a movable jaw with a gear-teethed inner bottom thereof, a slot formed aside said fixed jaw toward said movable jaw, whereby said movable jaw can slide along said slot, said head portion being further provided with an inner receptacle connected to said slot, said handle and said neck portion being respectively provided with a first open inner space and a second open inner space;

a worm gear disposed in said receptacle and engaged with said movable jaw, whereby said movable jaw can slide toward or away from said fixed jaw;

a flexible member disposed between said worm gear and a major gear wheel, whereby said flexible member will be twisted, said major gear wheel and a minor gear being connected through a first transmission member;

wherein the worn gear and the major gear wheel are coaxially aligned and have slots on for retaining a torsion spring therebetween; further, the major gear wheel is connected with a minor gear wheel having an outer gear wall through the transmission member with an inner gear surface whereby the major gear wheel and the minor gear wheel are moved synchronically;

a motor housed in said first open space and connected to said minor gear wheel through a second transmission member, said motor being electrically connected to a battery in said second open space;

a switch unit electrically connected said motor for controlling the activation of said motor; and a side cover detachable from said main body for covering said first and said second open spaces; and wherein said second transmission member is a torsion spring with two end connectors respectively coupled with said minor gear wheel and said motor; the second transmission member is a flexible part housed in the second region and the two end connectors are two T-shaped first and second connectors, being respectively coupled with a shaft of the minor gear wheel and a shaft of the motor;

wherein buttons of said switch unit are lower than the main body surface around said buttons for preventing accidental touches by a holding hand;

wherein said switch unit is located in said neck portion of said wrench; and wherein the switch unit is housed in the neck portion; one side of the switch unit is mounted on a retaining plate, and the opposite side thereof is supported against a hole in the main body and the through hole of the side cover, the two buttons of the switch unit move oppositely by pivoting about a fixed column going through a middle hole on the retaining plate; there are electrodes and springs between the button switch unit and the retaining plate.

2. The electric wrench of claim 1 wherein said second transmission member is a pair of bevel gear wheels respectively engaged with said minor gear wheel and said motor; said bevel gear wheels are connected through a belt for transmission.

3. The electric wrench of claim 1 wherein said first transmission member is a timing belt having an inner surface provided with teeth that can be engaged with the gear teeth on outer walls of said main and minor gear wheels.

4. The electric wrench of claim 1 wherein said side cover covers said first and second open spaces within said wrench by screw mechanisms; a box being housed in said second open space for housing said battery; said box being sealed by a cover plate.

5. The electric wrench of claim 1 wherein said switch unit is selected from a button-type and a dial-type.

6. The electric wrench of claim 1 wherein said switch unit consists of two sets respectively attached on two opposite sides of said wrench.

7. The electric wrench of claim 1 wherein said side cover is further provided with an upper extended portion extended to said receptacle for said major gear wheel.

8. The electric wrench of claim 1 wherein said flexible member is a torsion spring.

* * * * *